US008212545B2

(12) United States Patent
Imura

(10) Patent No.: US 8,212,545 B2
(45) Date of Patent: Jul. 3, 2012

(54) REFERENCE VOLTAGE CIRCUIT AND ELECTRONIC DEVICE

(75) Inventor: Takashi Imura, Chiba (JP)

(73) Assignee: Seiko Instruments Inc., Chiba (JP)

( * ) Notice: Subject to any disclaimer, the term of this patent is extended or adjusted under 35 U.S.C. 154(b) by 147 days.

(21) Appl. No.: 12/813,004

(22) Filed: Jun. 10, 2010

(65) Prior Publication Data

US 2011/0018520 A1 Jan. 27, 2011

(30) Foreign Application Priority Data

Jul. 24, 2009 (JP) ..... 2009-173384

(51) Int. Cl.
*G05F 3/08* (2006.01)
*G05F 1/46* (2006.01)

(52) U.S. Cl. ..... 323/313; 327/542

(58) Field of Classification Search ..... 323/268, 323/270, 311, 312, 313, 314; 327/541, 542, 327/543, 281
See application file for complete search history.

(56) References Cited

U.S. PATENT DOCUMENTS

| | | | | |
|---|---|---|---|---|
| 4,654,578 | A * | 3/1987 | Salerno et al. | 323/313 |
| 5,311,115 | A * | 5/1994 | Archer | 323/315 |
| 5,909,128 | A * | 6/1999 | Maeda | 326/116 |
| 6,005,378 | A * | 12/1999 | D'Angelo et al. | 323/313 |
| 7,479,821 | B2 * | 1/2009 | Imura | 327/538 |
| 7,982,531 | B2 * | 7/2011 | Yoshida et al. | 323/313 |
| 2003/0174014 | A1 * | 9/2003 | Nakashimo et al. | 327/542 |
| 2007/0221996 | A1 | 9/2007 | Imura | |
| 2010/0207686 | A1 * | 8/2010 | Lai et al. | 327/543 |

FOREIGN PATENT DOCUMENTS

JP 2007-266715 A 10/2007

* cited by examiner

*Primary Examiner* — Gary L Laxton
(74) *Attorney, Agent, or Firm* — Brinks Hofer Gilson & Lione

(57) ABSTRACT

In order to realize a reference voltage circuit that operates with lower current consumption while maintaining an operation at lower voltage without causing deterioration of a power supply rejection ratio, provided is a reference voltage circuit in which a depletion transistor of an ED type reference voltage circuit is constituted of a plurality of depletion transistors connected in series, and in which a gate terminal of a cascode depletion transistor is connected to a connection point between the depletion transistors of the ED type reference voltage circuit.

6 Claims, 4 Drawing Sheets

REFERENCE VOLTAGE CIRCUIT AND ELECTRONIC DEVICE

RELATED APPLICATIONS

This application claims priority under 35 U.S.C. §119 to Japanese Patent Application No. 2009-173384 filed on Jul. 24, 2009, the entire content of which is hereby incorporated by reference.

BACKGROUND OF THE INVENTION

1. Field of the Invention

The present invention relates to a semiconductor device, and more particularly, a reference voltage circuit having small output voltage fluctuations in response to power supply voltage fluctuations, which is capable of operating at lower voltage and with lower current consumption.

2. Description of the Related Art

In order to improve a power supply rejection ratio of an analog circuit, a method of adding a cascode circuit has been conventionally and widely employed. Further, a reference voltage circuit which is capable of improving the power supply rejection ratio while operating at lower voltage has been employed (for example, see Japanese Patent Application Laid-open No. 2007-266715). FIG. 4 is a circuit diagram illustrating a conventional reference voltage circuit.

An N-channel depletion type metal oxide semiconductor (MOS) transistor 301 and an N-channel enhancement type MOS transistor 302 form an enhancement depletion (ED) type reference voltage circuit 310. An N-channel depletion type MOS transistor 303 which operates as a cascode circuit is connected in series to the ED type reference voltage circuit 310. An N-channel enhancement type MOS transistor 304 serving as a control current source is connected in parallel with the N-channel enhancement type MOS transistor 302. An N-channel depletion type MOS transistor 305 having a gate terminal and a source terminal connected to each other is connected in series to the N-channel enhancement type MOS transistor 304. Further, the source terminal of the N-channel depletion type MOS transistor 305 is connected to a gate terminal of the N-channel depletion type MOS transistor 303. The N-channel enhancement type MOS transistor 304 and the N-channel depletion type MOS transistor 305 form a bias circuit 311 for supplying a constant bias voltage to the N-channel depletion type MOS transistor 303 which operates as the cascode circuit.

In the circuit described above, in a case where characteristics and transconductance coefficients of the N-channel enhancement type MOS transistors 302 and 304, and those of the N-channel depletion type MOS transistors 303 and 305 are the same, source-backgate voltage-drain current characteristics of the respective depletion type transistors are the same, and drain currents of the respective depletion type transistors are the same. Therefore, source potentials of the respective depletion type transistors are the same.

In this case, the source potential of the N-channel depletion type MOS transistor 305 may be made lower than the source potential of the N-channel depletion type MOS transistor 303 by employing the following methods:

(1) making the transconductance coefficient of the N-channel enhancement type MOS transistor 304 larger than the transconductance coefficient of the N-channel enhancement type MOS transistor 302 by, for example, fixing L length and increasing W length;

(2) making the transconductance coefficient of the N-channel depletion type MOS transistor 305 smaller than the transconductance coefficient of the N-channel depletion type MOS transistor 303; and (3) implementing both methods of (1) and (2) described above.

In this manner, the reference voltage circuit of FIG. 4 is capable of operating at lower voltage.

However, in the reference voltage circuit described above, current flows through two paths, which are a path from the N-channel depletion type MOS transistor 305 to the N-channel enhancement type MOS transistor 304 and a path from the N-channel depletion type MOS transistor 303 to the ED type reference voltage circuit 310. Therefore, there has been a disadvantage of high current consumption.

SUMMARY OF THE INVENTION

The present invention has been made to solve the problem described above, and therefore has an object to provide a reference voltage circuit that operates with lower current consumption without impairing an operation at lower voltage and causing deterioration of a power supply rejection ratio.

In order to solve the conventional problem described above, a reference voltage circuit according to the present invention includes a cascode depletion transistor and a depletion transistor for determining a reference voltage, the depletion transistor being constituted of a plurality of depletion transistors, in which a connection point between a drain of a first depletion transistor and a source of a second depletion transistor is connected to a gate terminal of the cascode depletion transistor.

According to the reference voltage circuit of the present invention, compared with a conventional circuit, it is possible to provide a reference voltage circuit that operates with lower current consumption without impairing the operation at lower voltage and causing the deterioration of the power supply rejection ratio.

DETAILED DESCRIPTION OF THE PREFERRED EMBODIMENTS

Figure 1:
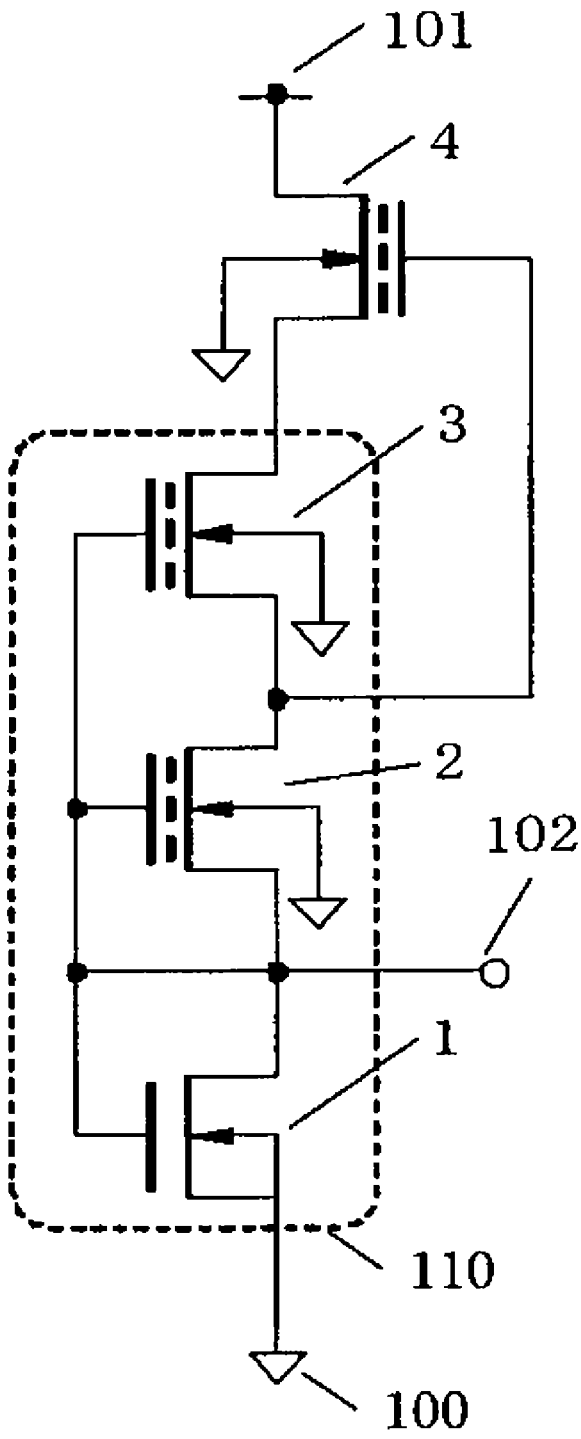
FIG. 1 is a circuit diagram illustrating a reference voltage circuit according to a first embodiment of the present invention.

FIG. 1 is a circuit diagram illustrating a reference voltage circuit according to a first embodiment of the present invention.

The reference voltage circuit according to this embodiment includes a power supply terminal 101, a ground (GND) terminal 100, an N-channel enhancement type metal oxide semiconductor (MOS) transistor 1, an N-channel depletion type MOS transistor 2, an N-channel depletion type MOS transistor 3, an N-channel depletion type MOS transistor 4, and an output terminal 102.

The N-channel depletion type MOS transistor 2 and the N-channel depletion type MOS transistor 3 are connected in series to each other, and gates thereof are commonly connected to each other. Further, the N-channel depletion type MOS transistor 2 and the N-channel depletion type MOS transistor 3 are connected in series to the N-channel enhancement type MOS transistor 1, and the gates thereof are commonly connected to a gate of the N-channel enhancement type MOS transistor 1. In other words, the N-channel enhancement type MOS transistor 1, the N-channel depletion type MOS transistor 2, and the N-channel depletion type MOS transistor 3 form an enhancement depletion (ED) type reference voltage circuit 110.

The N-channel depletion type MOS transistor 4 has a gate connected to a drain of the N-channel depletion type MOS transistor 2 and a source of the N-channel depletion type MOS transistor 3, a source connected to a drain of the N-channel depletion type MOS transistor 3, a drain connected to the power supply terminal 101, and a backgate connected to the GND terminal 100. In other words, the N-channel depletion type MOS transistor 4 operates as a cascode circuit with respect to the ED type reference voltage circuit 110.

The ED type reference voltage circuit 110 has an output terminal corresponding to a connection point between a source of the N-channel depletion type MOS transistor 2 and a drain of the N-channel enhancement type MOS transistor 1. Further, each of the N-channel depletion type MOS transistor 2 and the N-channel depletion type MOS transistor 3 is formed of one or more transistors.

In the circuit described above, the gate of the N-channel depletion type MOS transistor 4 is connected to the source of the N-channel depletion type MOS transistor 3 and the drain of the N-channel depletion type MOS transistor 2. Therefore, a gate potential of the N-channel depletion type MOS transistor 4 may be made lower than a source potential thereof by a drain-source voltage of the N-channel depletion type MOS transistor 3.

In this example, the gate potential of the N-channel depletion type MOS transistor 4 is lower than the source potential thereof, and hence $Vgs4<0$ is satisfied. As a result, it is possible to lower a minimum operating voltage VDD(min) as in a case of a conventional configuration, without providing another N-channel depletion type transistor with a low threshold value. In addition, current flows only through a path including the N-channel enhancement type MOS transistor 1, the N-channel depletion type MOS transistor 2, the N-channel depletion type MOS transistor 3, and the N-channel depletion type MOS transistor 4. As a result, it is possible to reduce the current consumption compared with that of the conventional circuit using a bias circuit.

It should be noted that a backgate of the N-channel depletion type MOS transistor 2 may be connected to the source of the N-channel depletion type MOS transistor 2. A backgate of the N-channel depletion type MOS transistor 3 may be connected to the source of the N-channel depletion type MOS transistor 3 or the source of the N-channel depletion type MOS transistor 2.

Figure 2:
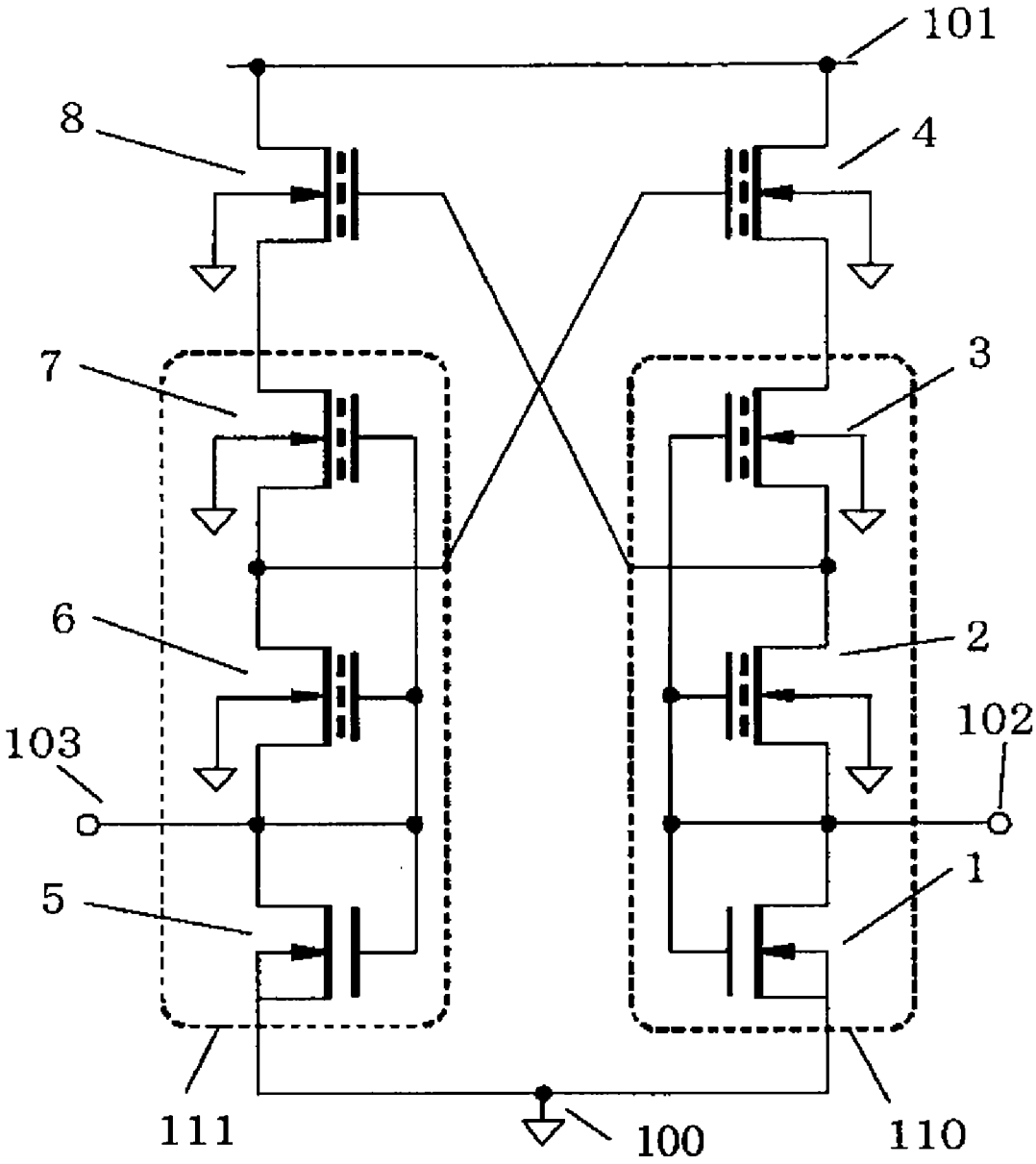
FIG. 2 is a circuit diagram illustrating a reference voltage circuit according to a second embodiment of the present invention.

FIG. 2 is a circuit diagram illustrating a reference voltage circuit according to a second embodiment of the present invention. The reference voltage circuit according to the second embodiment includes two reference voltage circuits of the first embodiment, and is formed so as to output equal reference voltages from two output terminals.

The reference voltage circuit according to the second embodiment includes the power supply terminal 101, the GND terminal 100, the N-channel enhancement type MOS transistor 1, an N-channel enhancement type MOS transistor 5, the N-channel depletion type MOS transistor 2, the N-channel depletion type MOS transistor 3, the N-channel depletion type MOS transistor 4, an N-channel depletion type MOS transistor 6, an N-channel depletion type MOS transistor 7, an N-channel depletion type MOS transistor 8, the output terminal 102, and an output terminal 103.

The N-channel depletion type MOS transistor 2 and the N-channel depletion type MOS transistor 3 are connected in series to each other, and the gates thereof are commonly connected to each other. Further, the N-channel depletion type MOS transistor 2 and the N-channel depletion type MOS transistor 3 are connected in series to the N-channel enhancement type MOS transistor 1, and the gates thereof are commonly connected to the gate of the N-channel enhancement type MOS transistor 1. In other words, the N-channel enhancement type MOS transistor 1, the N-channel depletion type MOS transistor 2, and the N-channel depletion type MOS transistor 3 form the ED type reference voltage circuit 110.

Similarly, the N-channel depletion type MOS transistor 6 and the N-channel depletion type MOS transistor 7 are connected in series to each other, and gates thereof are commonly connected to each other. Further, the N-channel depletion type MOS transistor 6 and the N-channel depletion type MOS transistor 7 are connected in series to the N-channel enhancement type MOS transistor 5, and the gates thereof are commonly connected to a gate of the N-channel enhancement type MOS transistor 5. In other words, the N-channel enhancement type MOS transistor 5, the N-channel depletion type MOS transistor 6, and the N-channel depletion type MOS transistor 7 form an ED type reference voltage circuit 111.

The N-channel depletion type MOS transistor 4 has the gate connected to a drain of the N-channel depletion type MOS transistor 6 and a source of the N-channel depletion type MOS transistor 7, the source connected to the drain of the N-channel depletion type MOS transistor 3, the drain connected to the power supply terminal 101, and the backgate connected to the GND terminal 100. In other words, the N-channel depletion type MOS transistor 4 operates as a cascode circuit with respect to the ED type reference voltage circuit 110.

The N-channel depletion type MOS transistor 8 has a gate connected to the drain of the N-channel depletion type MOS transistor 2 and the source of the N-channel depletion type MOS transistor 3, a source connected to a drain of the N-channel depletion type MOS transistor 7, a drain connected to the power supply terminal 101, and a backgate connected to the GND terminal 100. In other words, the N-channel depletion type MOS transistor 8 operates as a cascode circuit with respect to the ED type reference voltage circuit 111.

The ED type reference voltage circuit 110 has the output terminal corresponding to the connection point between the source of the N-channel depletion type MOS transistor 2 and the drain of the N-channel enhancement type MOS transistor 1. Further, each of the N-channel depletion type MOS transistor 2 and the N-channel depletion type MOS transistor 3 is formed of one or more transistors.

The ED type reference voltage circuit 111 has an output terminal corresponding to a connection point between a source of the N-channel depletion type MOS transistor 6 and a drain of the N-channel enhancement type MOS transistor 5. Further, each of the N-channel depletion type MOS transistor 6 and the N-channel depletion type MOS transistor 7 is formed of one or more transistors.

Also in the circuit described above, because the gate of the N-channel depletion type MOS transistor 4 is connected to the source of the N-channel depletion type MOS transistor 7 and the drain of the N-channel depletion type MOS transistor 6, the gate potential of the N-channel depletion type MOS transistor 4 may be made lower than the source potential thereof by a drain-source voltage of the N-channel depletion type MOS transistor 7. Further, the gate of the N-channel depletion type MOS transistor 8 is connected to the source of the N-channel depletion type MOS transistor 3 and the drain of the N-channel depletion type MOS transistor 2. Therefore, a gate potential of the N-channel depletion type MOS transistor 8 may be made lower than a source potential thereof by the drain-source voltage of the N-channel depletion type MOS transistor 3.

In this example, the gate potential of the N-channel depletion type MOS transistor 4 is lower than the source potential thereof, and hence $Vgs4<0$ is satisfied. Therefore, it is possible to lower the minimum operating voltage VDD(min). In addition, in the N-channel depletion type MOS transistor 8, similarly, the gate potential thereof is lower than the source potential thereof, and hence $Vgs8<0$ is satisfied. Therefore, it is possible to lower the minimum operating voltage VDD (min). Further, the same reference voltages may be obtained from two output terminals, that is, the output terminal 102 and the output terminal 103, as outputs. Further, a circuit for supplying a bias voltage is not required for the two outputs of the reference voltages, and hence current flows only through two paths. Therefore, it is possible to reduce the current consumption compared with that of the conventional configuration.

It should be noted that the backgate of the N-channel depletion type MOS transistor 2 may be connected to the source of the N-channel depletion type MOS transistor 2. The backgate of the N-channel depletion type MOS transistor 3 may be connected to the source of the N-channel depletion type MOS transistor 3 or the source of the N-channel depletion type MOS transistor 2.

In addition, a backgate of the N-channel depletion type MOS transistor 6 may be connected to the source of the N-channel depletion type MOS transistor 6. A backgate of the N-channel depletion type MOS transistor 7 may be connected to the source of the N-channel depletion type MOS transistor 7 or the source of the N-channel depletion type MOS transistor 6.

Figure 3:
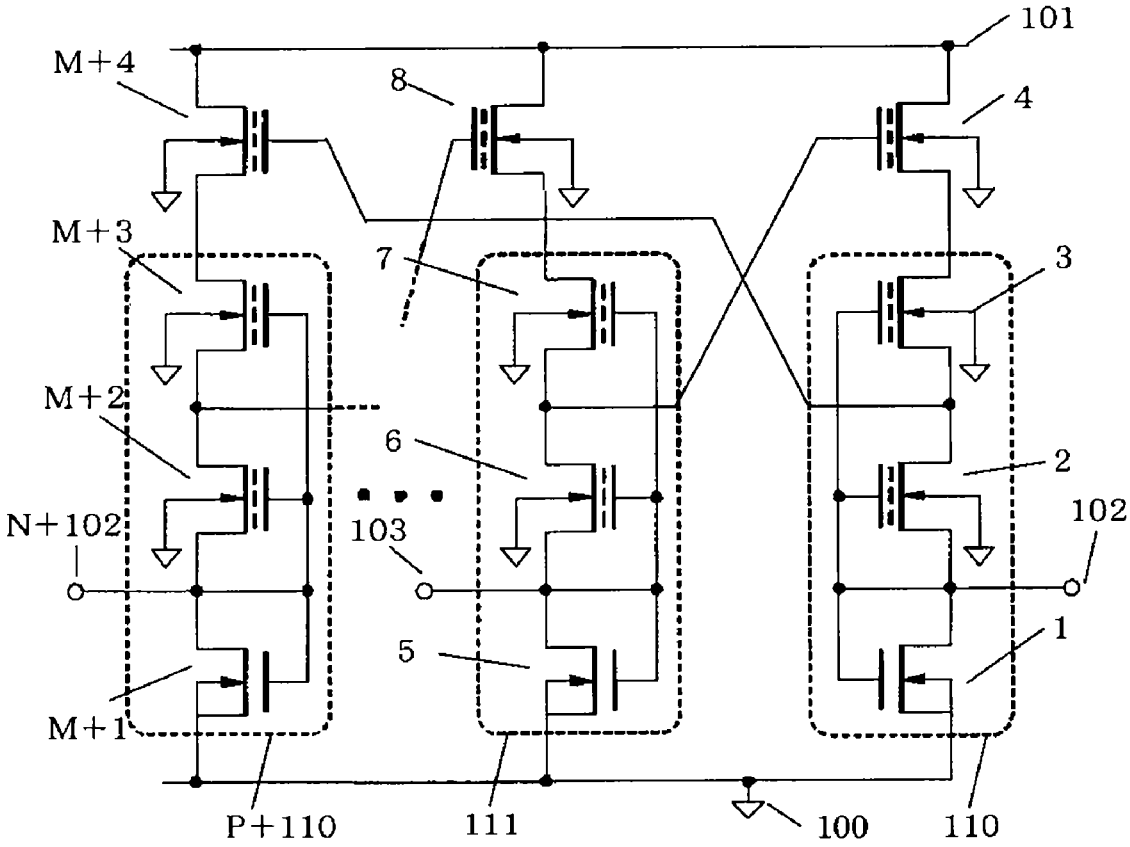
FIG. 3 is a circuit diagram illustrating a reference voltage circuit according to a third embodiment of the present invention.
Figure 4:
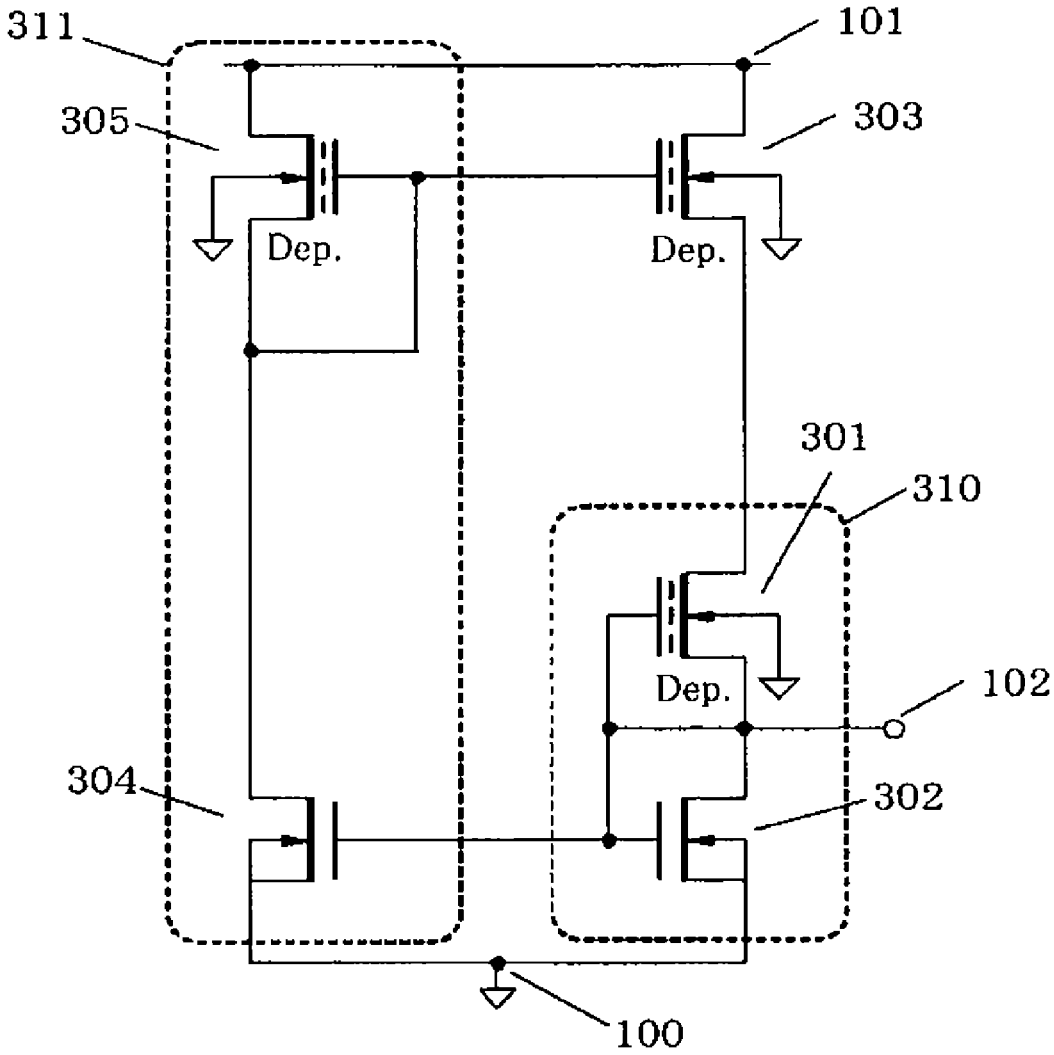
FIG.4 PRIOR ART
FIG. 4 is a circuit diagram illustrating a conventional reference voltage circuit.

FIG. 3 is a circuit diagram illustrating a reference voltage circuit according to a third embodiment of the present invention. In this example, "M" is 0 or a positive integer that is a multiple of 4. Each of "N" and "P" is 0 or a positive integer. The reference voltage circuit according to the third embodiment includes a plurality of reference voltage circuits of the first embodiment, and is formed so as to output equal reference voltages from a plurality of output terminals.

The N-channel depletion type MOS transistor 2 and the N-channel depletion type MOS transistor 3 are connected in series to each other, and the gates thereof are commonly connected to each other. Further, the N-channel depletion type MOS transistor 2 and the N-channel depletion type MOS transistor 3 are connected in series to the N-channel enhancement type MOS transistor 1, and the gates thereof are commonly connected to the gate of the N-channel enhancement type MOS transistor 1. In other words, the N-channel enhancement type MOS transistor 1, the N-channel depletion type MOS transistor 2, and the N-channel depletion type MOS transistor 3 form the ED type reference voltage circuit 110.

Similarly, the N-channel depletion type MOS transistor 6 and the N-channel depletion type MOS transistor 7 are connected in series to each other, and the gates thereof are commonly connected to each other. Further, the N-channel depletion type MOS transistor 6 and the N-channel depletion type MOS transistor 7 are connected in series to the N-channel enhancement type MOS transistor 5, and the gates thereof are commonly connected to the gate of the N-channel enhancement type MOS transistor 5. In other words, the N-channel enhancement type MOS transistor 5, the N-channel depletion type MOS transistor 6, and the N-channel depletion type MOS transistor 7 form the ED type reference voltage circuit 111.

Further, a plurality of reference voltage circuits having the same configuration are formed.

The N-channel depletion type MOS transistor 4 has the gate connected to the drain of the N-channel depletion type MOS transistor 6 and the source of the N-channel depletion type MOS transistor 7, the source connected to the drain of the N-channel depletion type MOS transistor 3, the drain connected to the power supply terminal 101, and the backgate connected to the GND terminal 100. In other words, the N-channel depletion type MOS transistor 4 operates as a cascode circuit with respect to the ED type reference voltage circuit 110.

The N-channel depletion type MOS transistor 8 has the source connected to the drain of the N-channel depletion type MOS transistor 7, the drain connected to the power supply terminal 101, and the backgate connected to the GND terminal 100. In other words, the N-channel depletion type MOS transistor 8 operates as a cascode circuit with respect to the ED type reference voltage circuit 111. Further, the gate of the N-channel depletion type MOS transistor 8 is connected to a drain of an N-channel depletion type MOS transistor 11 and a source of an N-channel depletion type MOS transistor 10 of the subsequent reference voltage circuit (not shown).

In the last reference voltage circuit having the same configuration, a gate of an N-channel depletion type MOS transistor M+4 operating as the cascode circuit is connected to the drain of the N-channel depletion type MOS transistor 2 and the source of the N-channel depletion type MOS transistor 3 of the first reference voltage circuit.

An ED type reference voltage circuit P+110 has an output terminal corresponding to a connection point between a source of an N-channel depletion type MOS transistor M+2 and a drain of an N-channel enhancement type MOS transistor M+1. Further, each of the N-channel depletion type MOS transistor M+2 and an N-channel depletion type MOS transistor M+3 is formed of one or more transistors.

Also in the circuit described above, gate potentials of all of the cascode transistors of the reference voltage circuits are lower than the source potentials thereof, and hence $Vgs4<0$ is satisfied. Therefore, it is possible to lower the minimum operating voltage VDD(min). In addition, the same reference voltages may be obtained from a plurality of output terminals N+102 ("N" is a positive integer). Further, a circuit for supplying a bias voltage is not required for the plurality of outputs of the reference voltages. Therefore, it is possible to reduce the current consumption compared with that of the conventional configuration.

It should be noted that a backgate of the N-channel depletion type MOS transistor M+2 may be connected to the source of the N-channel depletion type MOS transistor M+2. A backgate of the N-channel depletion type MOS transistor M+3 may be connected to a source of the N-channel depletion type MOS transistor M+3 or the source of the N-channel depletion type MOS transistor M+2.

As described above, according to the reference voltage circuit of the present invention, compared with the conventional circuit, it is possible to provide a reference voltage circuit that operates with lower current consumption without impairing an operation at lower voltage and causing deterioration of a power supply rejection ratio.

What is claimed is:

1. A reference voltage circuit, comprising:

an enhancement depletion (ED) type reference voltage circuit comprising:

an N-channel depletion type metal oxide semiconductor (MOS) transistor comprising:

a first N-channel depletion type MOS transistor having a source and a gate connected to an output terminal; and a second N-channel depletion type MOS transistor having a gate connected to the output terminal, and a source connected to a drain of the first N-channel depletion type MOS transistor, and an N-channel enhancement type MOS transistor comprising a drain and a gate connected to the output terminal, and a source connected to a ground (GND) terminal, and a cascode circuit disposed between a power supply terminal and the ED type reference voltage circuit, wherein the N-channel depletion type MOS transistor comprises a plurality of N-channel depletion type MOS transistors connected in series, and wherein the cascode circuit comprises an N-channel depletion type MOS transistor comprising a third N-channel depletion type MOS transistor having a drain connected to the power supply terminal, and a gate connected to the drain of the first N-channel depletion type MOS transistor and the source of the second N-channel depletion type MOS transistor.

2. A reference voltage circuit according to claim 1, wherein at least one of the first N-channel depletion type MOS transistor and the second N-channel depletion type MOS transistor comprises a plurality of N-channel depletion type MOS transistors.

3. An electronic device, comprising the reference voltage circuit according to claim 1.

4. A reference voltage circuit, comprising:

n ED type reference voltage circuits, where n is an integer of 2 or more, each comprising:

an N-channel depletion type MOS transistor comprising:

a first N-channel depletion type MOS transistor having a source and a gate connected to an output terminal; and a second N-channel depletion type MOS transistor having a gate connected to the output terminal, and a source connected to a drain of the first N-channel depletion type MOS transistor; and an N-channel enhancement type MOS transistor having a drain and a gate connected to the output terminal, and a source connected to a GND terminal, n cascode circuits each disposed between a power supply terminal and each of the n ED type reference voltage circuits, wherein the N-channel depletion type MOS transistor comprises a plurality of N-channel depletion type MOS transistors connected in series, wherein each of the n cascode circuits comprises an N-channel depletion type MOS transistor, wherein the N-channel depletion type MOS transistor of an m-th cascode circuit, where m is an integer satisfying $0<m<n$, has a gate connected to any one of connection points between the plurality of N-channel depletion type MOS transistors connected in series of an (m+1)-th ED type reference voltage circuit, and wherein the N-channel depletion type MOS transistor of an n-th cascode circuit has a gate connected to any one of connection points between the plurality of N-channel depletion type MOS transistors connected in series of a first ED type reference voltage circuit, wherein the N-channel depletion type MOS transistor of each of the n cascade circuits comprises a third N-channel depletion type MOS transistor having a drain connected to the power supply terminal, and a gate connected to the drain of the first N-channel depletion type MOS transistor and the source of the second N-channel depletion type MOS transistor.

5. A reference voltage circuit according to claim 4, wherein at least one of the first N-channel depletion type MOS transistor and the second N-channel depletion type MOS transistor comprises a plurality of N-channel depletion type MOS transistors.

6. An electronic device, comprising the reference voltage circuit according to claim 4.

* * * * *